US010024030B2

(12) United States Patent
Melrose

(10) Patent No.: US 10,024,030 B2
(45) Date of Patent: Jul. 17, 2018

(54) FRONT UNLOADING SCRAPER

(76) Inventor: Clayton A Melrose, Oakes, ND (US)

( * ) Notice: Subject to any disclaimer, the term of this patent is extended or adjusted under 35 U.S.C. 154(b) by 442 days.

(21) Appl. No.: 13/544,355

(22) Filed: Jul. 9, 2012

(65) Prior Publication Data

US 2013/0008061 A1 Jan. 10, 2013

Related U.S. Application Data

(60) Provisional application No. 61/505,615, filed on Jul. 8, 2011.

(51) Int. Cl.
*E02F 3/64* (2006.01)
*E02F 3/65* (2006.01)

(52) U.S. Cl.
CPC ..... *E02F 3/6418* (2013.01); *E02F 3/657* (2013.01); *E02F 3/658* (2013.01)

(58) Field of Classification Search
CPC ..... E02F 3/64; E02F 3/6409; E02F 3/6418; E02F 3/6427; E02F 3/6436; E02F 3/6454; E02F 3/6463; E02F 3/6472; E02F 3/6481; E02F 3/653; E02F 3/657; E02F 3/658
USPC ..... 37/416, 421, 427, 431, 432, 437–439
See application file for complete search history.

(56) References Cited

U.S. PATENT DOCUMENTS

| | | | | |
|---|---|---|---|---|
| 3,330,054 | A * | 7/1967 | Martin | 37/428 |
| 3,418,735 | A * | 12/1968 | Martin | 37/431 |
| 3,427,736 | A * | 2/1969 | Martin | 37/431 |
| 4,892,155 | A * | 1/1990 | Wanamaker | 172/199 |
| 5,339,613 | A * | 8/1994 | Wymore | 56/344 |
| 5,806,607 | A * | 9/1998 | Sanders | 172/253 |
| 7,454,850 | B2 * | 11/2008 | Smith | 37/417 |
| 7,491,027 | B1 * | 2/2009 | McFarland et al. | 414/724 |
| 8,302,891 | B2 * | 11/2012 | Koehn et al. | 241/30 |
| 2010/0122477 | A1 * | 5/2010 | Roley | 37/416 |

* cited by examiner

*Primary Examiner* — Robert Pezzuto
*Assistant Examiner* — Jessica H Lutz
(74) *Attorney, Agent, or Firm* — Babcock Legal Services

(57) ABSTRACT

A scraper has an apron, a bowl, a cutting edge, a vehicle attachment, and a pivoting mechanism such that the scraper has a flat position and an angled position. In the flat position the cutting edge is in position to cut into dirt and store the dirt in the bowl, while in the angled position the scraper is rotated such that dirt within the bowl can drop onto the ground in front of the scraper.

18 Claims, 5 Drawing Sheets

FRONT UNLOADING SCRAPER

CROSS-REFERENCE TO RELATED APPLICATIONS

This application claims priority to provisional application 61/505,615 filed Jul. 8, 2011.

FIELD OF THE INVENTION

This invention relates to a scraper capable of delivering material to other locations without having to run over the area in which the material is delivered.

BACKGROUND OF THE INVENTION

Existing scrapers drop material beneath them while traveling as they unload. This prohibits scrapers from unloading into locations that are not first run over by the scraper or vehicle.

This limitation does not allow material within a scraper to be unloaded over a trench, close to an edifice/structure or other vehicle, or stock pile. It also prevents material to be unloaded from the scraper onto more fragile landscaping or fragile structures such as tanks, utility lines, sidewalks, etc. as the weight of the scraper could cause damage.

There is a need within landscaping systems including surface grading, finishing, and planting for a scraper that can unload material on areas before running over them. Such a need also exists at construction sites. Driveway and trail construction systems and sidewalk and other concrete flat work construction systems have a need for such a scraper that can move earth to meet design requirement, to prepare an area to grade, to place required bed material into the area in which concrete is to be poured. There is a great need for such a scraper and the specific listings given are for merely purposes of showing that need and in no way limit the areas in which such a scraper can be used.

The instant invention as disclosed within this application, provides a scraper that fills this need. The art referred to and/or described within this application is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention can be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, the scraper has an apron, a bowl, a cutting edge, a vehicle attachment, and a pivoting mechanism such that the scraper has a flat position and an angled position; in the flat position the cutting edge is in position to cut into dirt and store the dirt in the bowl, while in the angled position the scraper is rotated such that dirt within the bowl can drop onto the ground.

In at least one embodiment the cutting edge is connected to the apron and/or the bowl and/or is a part of the apron and/or the bowl. In at least one embodiment the cutting edge has multiple cutting blades. In some embodiments one blade extends farther than at least one other blade. In some embodiments the cutting edge is curved and of single construction. In some embodiments the cutting edge is curved and has multiple blades. In some embodiments the cutting edge is straight and/or has multiple blades. In at least one embodiment, a middle portion of the cutting edge extends further than one or more side portions.

In at least one embodiment the pivoting mechanism comprises a hydraulic cylinder or other actuating device hydraulically or electrically driven that extends to move the scraper into the angled position and retracts to move the scraper into the flat position. In at least one embodiment the hydraulic cylinder extends to move the scraper into the flat position and retracts to move the scraper into the angled position.

In at least one embodiment, the scraper includes one or more wheels attached to the front portion of the scraper. In at least one embodiment, the wheels are removably attached to the scraper.

In some embodiments, the scraper is designed to be lifted entirely off the ground when dumping dirt. In some embodiments the dumping position is within 5 feet of the front most portion of the attached vehicle. The dumping position is the position at which the dirt is first released to the ground and measured transversely along the ground from the front most portion of the attached vehicle.

In some embodiments the scraper is self-propelled having a motorized vehicle portion and a scraping portion wherein the scraping portion can have an apron, a bowl, a cutting edge, and a pivoting mechanism such that the scraper has a flat position and an angled position; in the flat position the cutting edge is in position to cut into dirt and store the dirt in the bowl, while in the angled position the scraper is rotated such that dirt within the bowl can drop onto the ground, the motorized vehicle portion capable of positioning the apron, the bowl, the cutting edge above the ground.

Again, in some embodiments, the self-propelled scraper can have a dumping position that is within 5 feet of the front most portion of the motorized vehicle portion. In some embodiments, the motorized vehicle portion is a push vehicle designed to attach and unattach to the scraping portion. As used here "designed to attach and unattach" refers to attachment that can be temporary and is not intended to be permanent. Some examples of this kind of attachment are bolts and/or screws and/or nuts and/or pins that hold items together. Wedges, wedge bars, and/or latches can be used. One skilled in the art is well aware of different attachment types.

This inventive scraper can self-load and can then unload by being able to unload in front of the unit where it cannot be possible to drive. This scraper is unique in its ability to unload in front of itself. The invention is also unique in that, in some embodiments, it does not require relative rotation between the frame and the bowl to unload. Whether this scraper unloads conventionally beneath it or uniquely into a pile in front of the machine, in as much as any minimal relative rotation between the frame and the bowl occurs during unloading; it is not necessary.

BRIEF DESCRIPTION OF THE SEVERAL VIEWS OF THE DRAWING(S)

A detailed description of the invention is hereafter described with specific reference being made to the drawing.

DETAILED DESCRIPTION OF THE INVENTION

While this invention can be embodied in many different forms, there are described in detail herein specific preferred embodiments of the invention. This description is an exemplification of the principles of the invention and is not intended to limit the invention to the particular embodiments illustrated. It should be noted that the term "flat position" refers to multiple positions that are primarily used when scraping the ground. The "angled position" refers to multiple positions that are primarily used when the dirt is being dumped onto the ground. Throughout this application the term "dirt" should be understood as any material which the scraper is scraping. Also, the term "ground" should be understood to mean any surface the scraper is disposed on or over.

Figure 6:
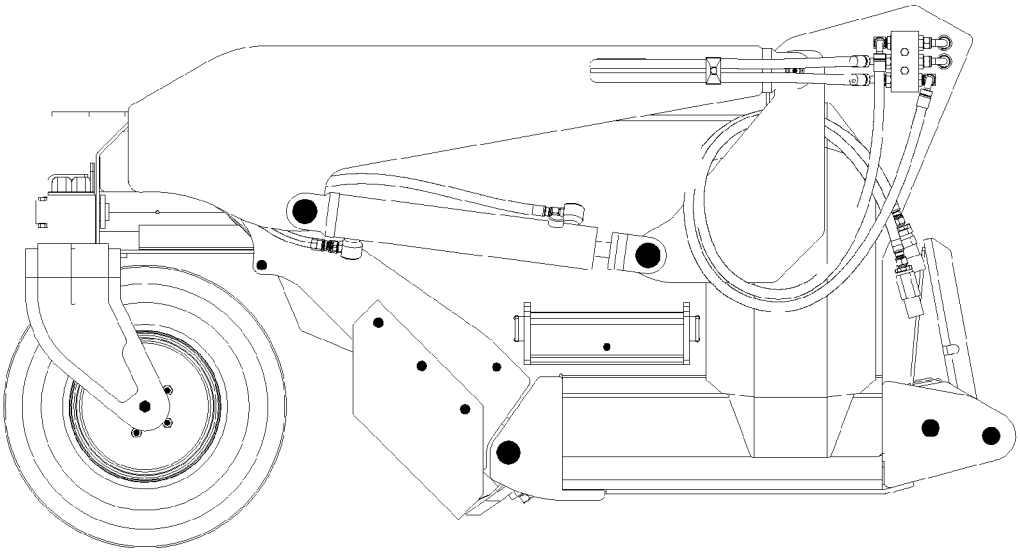
FIGS. 6-7 are side views of an embodied scraper of the invention.
Figure 7:
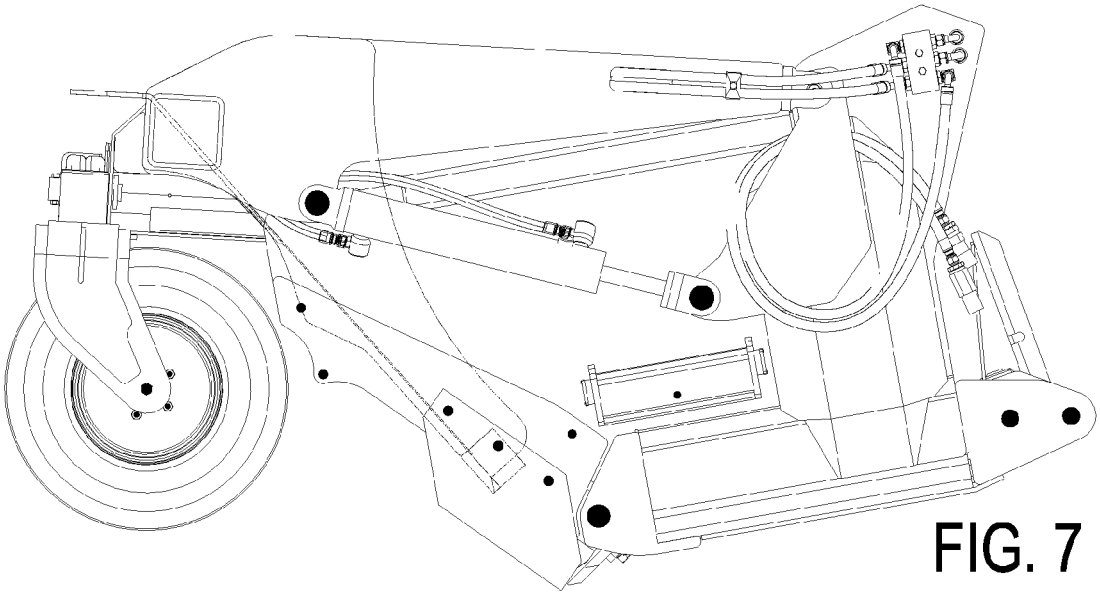
Figure 8:
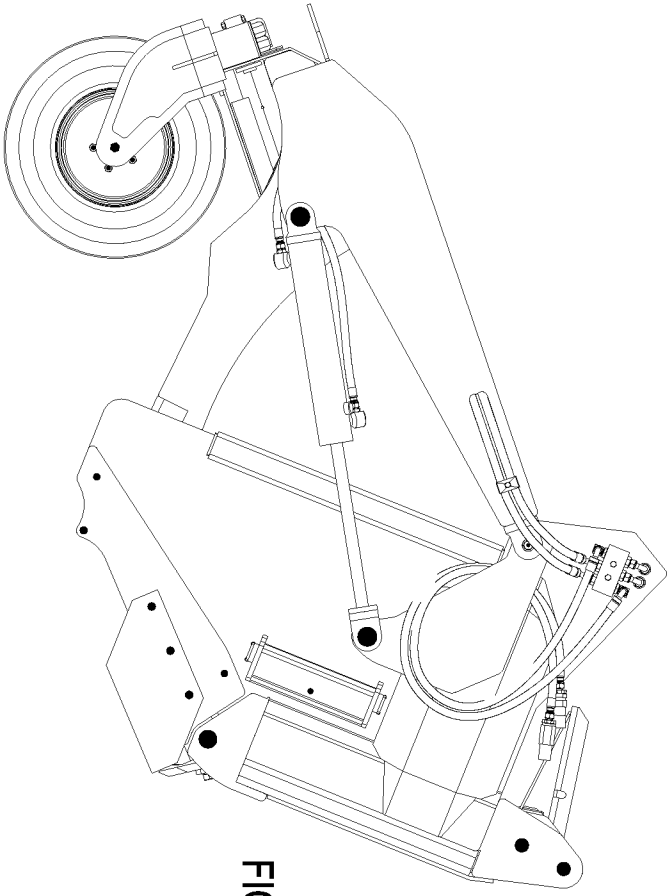
FIGS. 8-9 are side views of an embodied scraper of the invention.
Figure 9:
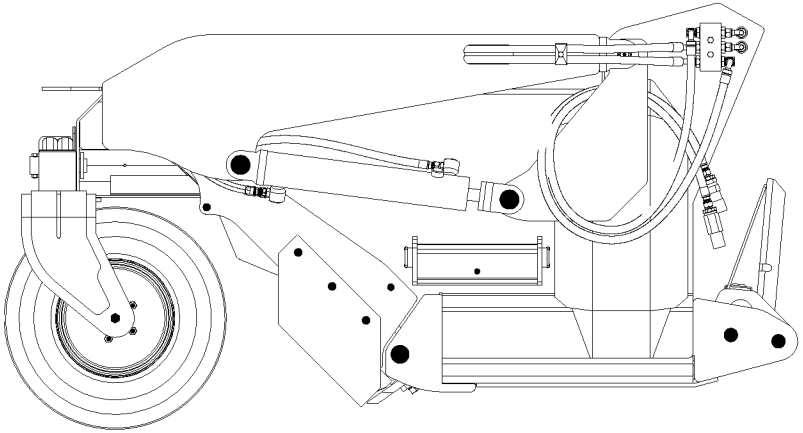

The embodiments of the invention include the capabilities to remove existing earth, transport it to a new location, and/or unload it into a pile or into a trench. Optionally, the material could be unloaded into a distributed layer while the scraper is moving as it unloads. To fill the bowl of the scraper 1 the front edge of the bowl 2 can be lowered (FIG. 7) beneath the surface of the earth to be removed as the invention moves forward into the earth. This can cut a ribbon of earth by the blade set 6 on the front of the bowl 2 to feed a ribbon of earth along the floor and into a coiling ball of earth that fills the bowl 2. The bowl 2 front can then be lifted to a transport position and the apron is closed (FIG. 6). The load can be then carried in the scraper 1 to the location in which it can be to be unloaded. The dumping scraper 1 can be stopped and its rear end, attached to a push vehicle, can be lifted by the attached vehicle; tilting the scraper forward to a near vertical position (FIG. 9). This dumps the load of material in front of the dumping scraper 1. Material can alternatively be unloaded from the bowl 2 as the bowl 2 moves forward over the top of the layer of unloading earth (FIG. 8). Alternatively, the bowl 2 can be loaded from the top while the scraper 1 is either moving or stationary.

The parts included in this invention can be painted or otherwise finished. These components could then be assembled and finished. One could provide the remaining parts to assemble the machine to the point required to complete any remaining painting or finishing. Finally, the final assembly and packaging for shipment or use could be completed.

The dumping scraper 1 can be a carrying bowl scraper device configured and designed to mount to a skid-steer vehicle or the like to self load, move, and self unload earth into a pile as well as into a distributed layer.

Figure 1:
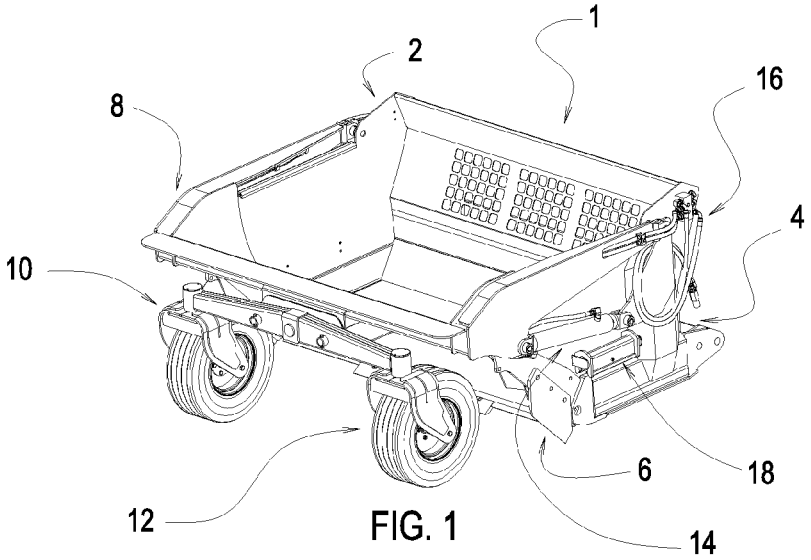
FIG. 1 is a perspective view of an embodied scraper of the invention.
Figure 3:
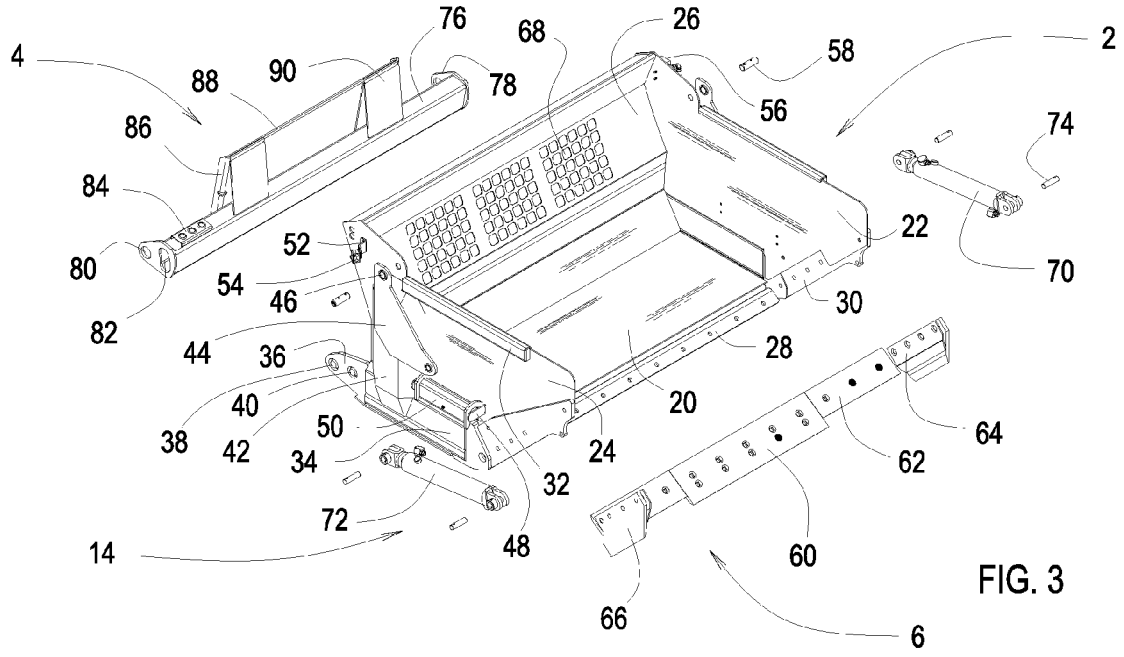
FIG. 3 is a perspective view of the bowl with attaching parts of an embodied scraper.

As illustrated in FIG. 1, the bowl 2 is a container which is configured and designed to accumulate, hold, and/or carry earth scraped by the leading edge of its floor in its front. The bowl 2 can otherwise be filled from the top. Some means are by conveying or dumping from a bucket. As shown in FIG. 3, the bowl 2 can have a floor 20 that is substantially flat or it can have a curved surface in, but not limited to, the direction of travel. The floor can be substantially horizontal in the transport configuration or can be inclined slightly such as between up to 15° inclined forward or rearward relative to the horizontal plane. The floor can have a front blade support 28 to accommodate a cutting edge that can or cannot be removable and can be inclined toward the ground at an angle, such as up to 60° from the floor. The floors cutting edge 60 and 62 can consist of a single piece or a plurality of segments, preferably numbering 3. The center blade 60 can be wider to make a deeper cut than the adjacent segments 62 to improve material flow into the bowl.

As illustrated in FIG. 3, cutting edges 60 and 62 of cutting blade 6 can be reversible top to bottom to provide multiple cutting edges and wear areas. Blade segments 62 can be substantially the same on either side of the center blade 60 to avoid left and right parts and can be symmetrical top to bottom to provide multiple cutting edges and wear areas. The floor 20, as well as other bowl parts, can comprise any hard supportive material known in the art including, but not limited to, metal, plastic, and/or composite. The bowl 2 can have a left side 22 and a right side 24 that can be substantially vertical or can be inclined inward or outward at its top slightly, such as up to 15°, relative to the vertical plane. The sides can have reinforcements including but not limited to the top channel 32, bottom channel 34, spacer 42, or support 30. The side can, as shown with support 30, accommodate side cutting edges which can be used to protect the sides from wear as well as to help cut earth being removed from adjacent material. Side cutting edges can be located on the inside of the side edge support 30 as shown by the inside side edge 64, or on the outside as the side edge 66, or both. Alternatively side edges need not be used at all. Cutting edge set 6 can comprise any hard, supportive material known in the art, including, but not limited to, high carbon steel, heat treatable alloy, highly wear resistant steel, or other wear resistant material.

The back 26 generally closes the area to the rear of the bowl 2 between the sides 22 and 24 to retain material in the bowl. The back can be in a fixed location with respect to the bowl and can be attached to or supported by any combination of floor or side parts. The back can alternatively be free to move with respect to the floor, or sides and can be moved to act as an ejector. The back can translate or rotate to move material, especially near the floor, toward the bowl's exit. The back 26 can be generally vertical or can have surfaces inclined to vertical which can help direct the flow of material in the bowl. A surface at the bottom of the back can be inclined like a gusset between the floor and the back to help redirect material flowing back across the floor to flow upward on the back. A surface inclined forward of vertical on the back, preferably near its top, can direct material flowing up the back into the preferred forward rolling rotation to reduce the forward force required to load the scraper and to reduce material spillage over the top of the back. The back 26 can be solid or can have a window 68 or grate area to provide visibility thru the bowl back 26.

Surfaces inclined back from vertical can be used to reduce damage or war from the flow of material against his windowed area. The window area could include, but is not limited to, a plurality of holes, an inserted grate, louver, and opening covered by transparent material and/or a combination of visibility facilitating devices known in the art.

The frame assembly 4 can accommodate parts including, but not limited to, the step 84, the attachment plates 86, the wedge bar 88, and the brace plates 90 as illustrated in FIG. 3. Other parts known in the art to be appropriate for the connection of attachments to the particular vehicle accommodated to move, carry, and/or use the dumping scraper 1 can alternatively be used on the frame 4 to provide connection to that vehicle. The frame tube 76 can be fixed solidly to scraper bowl 2 or even eliminated by attaching vehicle attachment part directly to the bowl. The preferred method of attachment of a vehicle to scraper 1 includes, but is not limited to a hinge with a limited range of rotation such as 30° as shown. Any flexible joint between the vehicle and scraper 1 which allows for change in angle between them, particularly in the direction of travel, can be used to accommodate uneven ground conditions. This includes but is not limited to a flexible member, a torsion spring, a hinge or any joint known in the art. The preferred method of attachment of a vehicle to scraper 1 shows surface 80 of end plate 78 able to rotate on pin 38 of the bracket 36. The pin 40 in slot 82 limits the rotation of frame 4 to a limited range of motion such as 30°. Limited rotation can be used to help control the dumping scraper 1 particularly when in the dumped position of FIG. 9.

Figure 2:
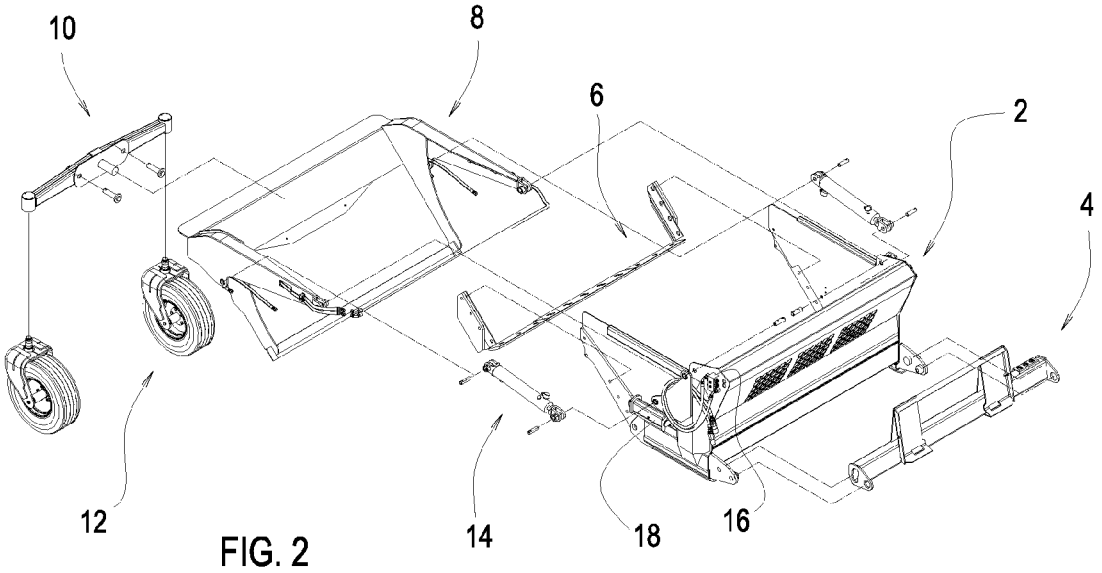
FIG. 2 is an exploded perspective view of the embodied scraper of FIG. 1.
Figure 5:
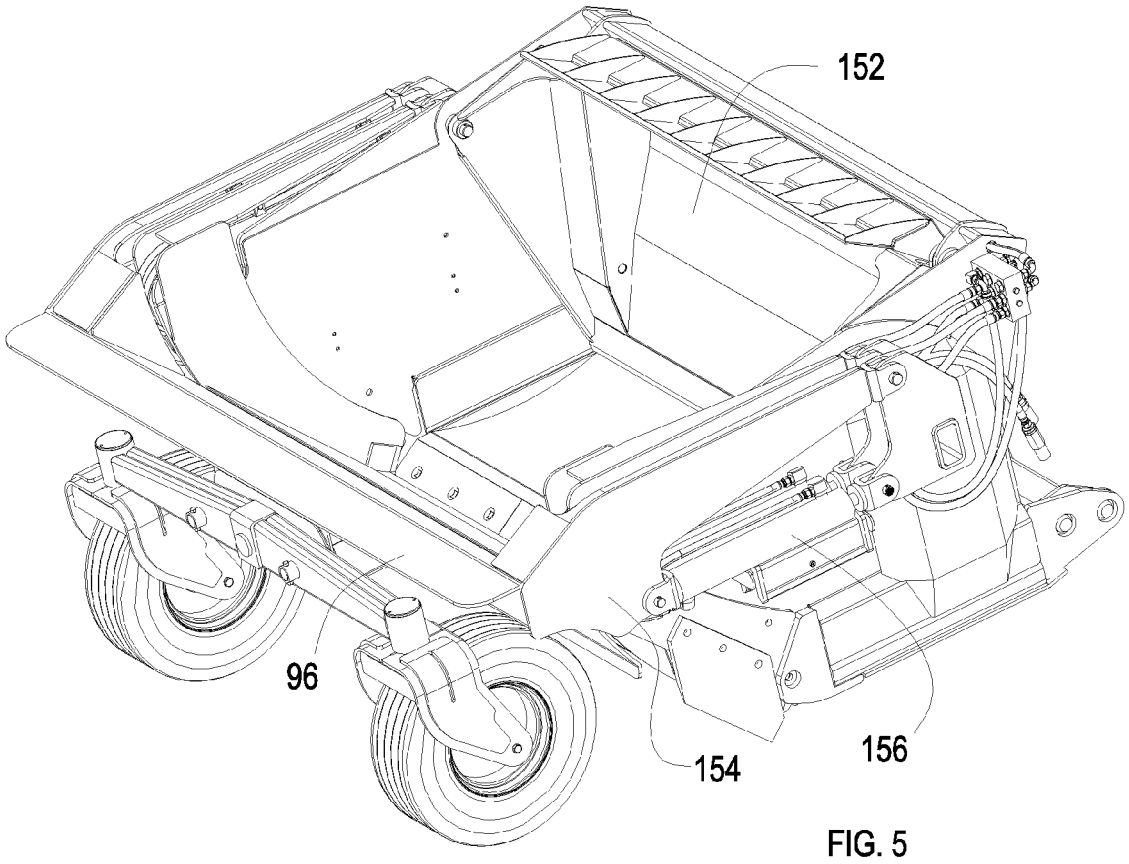
FIG. 5 is a perspective view of an embodied scraper of the invention.

Bowl 2 can accommodate additional parts including, but not limited to parts shown such as hose clamp bracket 52 with attached hose clamp 54, hydraulic manifold 56, and cylinder stop 50 shown stored on cylinder stop rack 48. The apron pivot bushing 46 in the apron mount 44 can have a location on, but not limited to, the side spacer 42. The mount 44 can optionally accommodate an apron cylinder 72 as well as the apron 8. The apron cylinder set 14 (see FIG. 2) can be a single cylinder, a left cylinder 70 and a right cylinder 72, or a plurality of cylinders. Cylinders can be set up as a set of phasing cylinders as shown and/or they can be used in parallel. The respective plumbing assembly 16 of FIGS. 2 and 5 can consist of the appropriate hoses, fittings, and other components known in the art.

Figure 4:
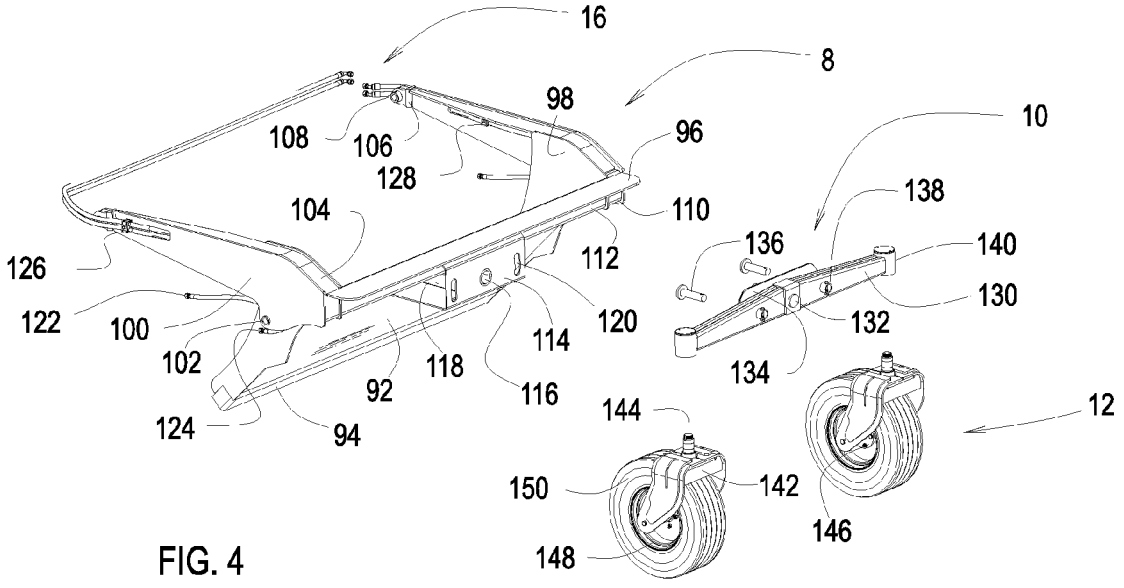
FIG. 4 is a perspective view of the apron with attaching parts of an embodied scraper.

As illustrated in FIG. 4, the apron 8 is a device configured and designed to act as a door at the front of the bowl 2. It can have a front panel 92. Reinforcement of the panel 92 can include, but is not limited to, the apron bottom 94 shown at the bottom, the side gusset 98 at each side, and the lip 96 at the top. The lip 96 can be stiffened with angle 112, and the torque tubes 110 can space the outsides arms 100. The bushings 102 in the apron 8 outside arms 100 can secure the pins 74 in one end of the apron cylinders 70 or 72. Spacers 104 at the top of the arms 100 can extend back to the hinges 106 which include the bushings 108 to anchor the pins 58 as a pivot for the apron 8. Attachment plate 114 can accommodate pivot bushing 116 supported by gussets 118. Bushing 116 can carry the front of the apron 8 on the pin 132 in caster beam 10. The push plate 134 can be held in location by the headed pins 136 thru slots 120 and secured in the bushings 138. The caster mounts 140 at either end of the caster beam 130 can accommodate caster assembly 12 by retention of its pivot pin 144 as a pivot axis for the fork 142. The hubs 146 carry the wheels 148 and the tires 150. A variety of caster beams, beam mounts, caster pins with respective bearings or bushings, caster bearing pivot arrangements, single or double fork styles, hub types, wheel styles, and tire types known in the art could be substituted for those shown.

The attachment described which carries the front of the machine on the wheels can be incorporated into the apron. In one embodiment illustrated in FIG. 5, wheels are attached to the top of the apron while the bottom and remainder of the apron moves independently with respect to the wheels. In another embodiment, the wheels could be attached to a cross beam with arms and move totally independent of the apron. This configuration would be similar to the front wheels under the draft arms of a conventional towed scraper.

The apron 8 or other locations can accommodate additional parts, including but not limited to, outside hose clamps 126, inside hose clamps 128, hydraulic hose 122, and hose 124.

The bowl sides 22 and 24 are preferably connected to the floor 20 above the floor 20. Any connections described in this application can include any known connectors, including screws, bolts, rivets, adhesives, welds, etc. The sides 22 and 24 are preferably connected perpendicularly to the floor 20, although they can instead be angled relative to the floor 20 at angles such as 80° to 110°.

The bowl back 26 can be attached to the floor 20 at the rear of the floor 20 and can additionally be attached to the sides 22 and 24. Alternatively the back 26 could be attached only to the floor 20 or only to the sides 22 and 24. Furthermore the back 26 need not be unattached to the floor 20 or the sides 22 and 24. This can be done to accommodate moving the back 26 forward above the floor 20 and between the sides 22 and 24 for use as an ejector of material from the bowl 2. In this case the back used as an ejector (FIG. 5) can be guided with guides, linkages, or parts known in the art to facilitate translation or rotation and would be moved by hydraulic cylinder, rack and pinion, linear actuator, or other device known in the art. Alternatively a separate ejector 152, aside from the back, can alternatively be used in conjunction with a back, a partial back, or member or members between the sides in the area of the back.

The cutting blade support 28 can be attached to the front of the bowl bottom 20 preferably at the front edge. It can attach to additional parts such as, but not limited to, the sides 22 and 24 or the edge supports 30 which can also be attached to the floor 20 or sides 22 and 24. The blade support 28 and optionally the side supports 30 form the mouth of the bowl at its bottom where earth cut from its surroundings normally enters the bowl. The blade support 28 supports blades making a somewhat horizontal cut whereas support 30 accommodates blades that make a somewhat vertical cut to sever a ribbon of material from its surroundings. The blades 60 and 62 of blade set 6 can be accommodated for removal by the support 28 preferably attached at the front of floor 20. The front cutting edge is preferably tilted downward at an angle between 30° and 45° although it could be tilted at a greater angle or a lesser angle even to the extent of being flat with the floor. The side blades 64 and 66 are preferably attached at the bottom of the front of the sides 22 and 24 adjacent to the floor 20. The side blades can be horizontal but preferably have any upward angle toward their front end to accommodate deeper cutting depths and can even be vertical. The blades have a length and width. As shown in FIG. 3, the length is measured in a direction from one side of the scraper 22 to the other side 24. The width is the shorter dimension of each blade 60 and 62 shown in FIG. 3. As such the different widths of blades 60 and 62 give a staggered edge to blade set 6.

The sides 22 and 24 are preferably attached to the floor and can optionally be attached to the front 28 or side 30 blade supports, the back 26, the frame 4, or other members. The connections as well as the sides themselves can be strengthened with members including but not limited to, channels 34, frame brackets 36, spacers 42, top channels 32, and apron mounts 44. The cylinder stops 50 stowed on stop racks 48 are preferably on the outside of sides 22 and 24 but could also be on the top or back side of the back 26 or attached at another convenient location. Addition parts attached to the sides can include, but are not limited to, the hose clamp 54 on the bracket 52, the hydraulic manifold 56, the cylinders 70 and 72, and the bushings for the apron attaching pins 58.

The frame brackets 36 are preferably attached to the outside of sides 22 and 24 and/or floor 20 and are preferably located to facilitate a low location of frame brackets 36 with respect to the attached vehicle. The brackets 36 preferably include a pin 38 which provides flexibility between the scraper 1 and its attached vehicle. It can also be the location at which the scraper is pushed by the vehicle and can be the lift point as well. The brackets 36 preferably also include a pin 40 to limit rotation between the frame and bowl. Higher locations of brackets 36 on bowl 2 can also be used. If the mount is ridged, instead of accommodating flexibility between the scraper 1 and the attached vehicle as shown in FIG. 3, the higher location of the brackets may be beneficial.

The mount 36 provides a hinged mounting to the vehicle attached to the frame 4. The beam 76 can include attached step 84 or other steps know in the art to facilitate climbing around the scraper 1 or into the vehicle and can alternatively be located in any convenient location. Beam 76 preferably includes brackets 78 which can provide a mating surface for pin 38 as well as a rotation limiting slot to accommodate pin 40.

Beam 76 of frame 4 can also accommodate parts for attachment of the scraper 1 to a vehicle. Attachment parts vary according to the requirement needs of the attaching vehicle being accommodated. The attachment parts accommodate the vehicle. The plates 86 and the wedge bar 88 accommodate attachment to a skid-steer vehicle. Plates 86 are preferably tilted forward form vertical such as 10° to 20°. Larger angles of rotation can optionally be used if the scraper frame has a more fixed position such as in a style where the bowl rotates with respect to the frame for unloading. Vehicle attachment parts are preferably located differently to accommodate other types of vehicles such as those with forks, a 3-point hitch, or other attachment accommodations.

The apron bottom 94 is preferably attached to the bottom of apron panel 92. Both are located in the front open end of bowl 2. The apron bottom 94 and the panel 92 can be connected thru accommodating parts such as the gussets 98, the arms 100 shown with cylinder mounting bushings 102, and spacers 104 to hinges 106 shown with optional bushings 108. These can act as apron carrying hinged arms and are preferably located at the sides of the apron 8. The axis of rotation of hinges 106 is preferably parallel to the bottom edge of the apron 94. Preferably a plane thru the axis of rotation of hinges 106 and perpendicular to the apron 8 will intersect flat apron 8. Preferably a plane thru this rotation axis of hinge 106 and perpendicular to an are cord from the top to the bottom of a top to bottom curved apron 8 would intersect the cord within the height of the apron rather than intersecting the cord at a point above or below the apron 8. The apron 8 can be moved by the cylinders set 14 and plumbing assembly 16. The apron 8 can alternatively be translated or otherwise moved into position instead of being rotated about an axis. The apron lip 96 is preferably attached to the apron carrier plate 114 and bushing 116 that accommodates pin 132 thru push plate 134 on beam 130 to carry the front weight of dumping scraper 1 on attached beam 10 with casters 12. Tubes 110 and an angle 112 support lip 96 along its length and gussets 118 brace the tube 116 in the carrier 114. The lip 96 and carrier 114 with mentioned related parts are preferably attached to the top of apron 8 as show. Alternatively the lip 96 and carrier 114 with related parts just mentioned could remain separate from the rest of the apron 8 and could instead be attached to a separate set of arms 154 with their respective actuator 156 which move the casters 12 and beam 10 independently form the rest of the apron.

The carrier beam 130 is preferably attached to the apron carrier plate 114 with the pins 136 fastened in the bushings 138 accommodated in slots 120 so the beam 130 can oscillate. The casters 12 are preferably mounted by their pivot shafts 144 in bearings inside of the beam bushing 140. The tire 150 can be mounted on the wheel 148 and is preferably fastened to the flange of the hub 146. Preferably shafts are provided thru the hub 146 and attached to each side of the fork 142.

In some embodiments the bowl 2, apron 8, and at least one wheel 12 are the only necessary parts. In some embodiments, attachment plates 86 and bar 88 from frame 4 are permanently affixed and/or become part of bowl 2. In some embodiments, the cutting blades 6 can offer quick replacement of material which can wear from the bowl 2 during use. In some embodiments, the frame 4 can provide for a superior ride over uneven ground. In some embodiments, the beam 10 and a second wheel 12 can provide improved balance and stability. The hydraulic cylinder set 14 can hold the cutting edge of bowl 2 in place with respect to the wheels 12 for cutting depth control and can also hold the bowl 2 closed during transport as shown in the configuration illustrated. This allows a smaller vehicle to handle a large load with an improved ride and reduce bottom spillage over uneven terrain.

In at least one embodiment, the vehicle transports the scraper portion to the location of earth removal, the front cutting edge of the bowl 1 can then be lowered into the earth below the top surface of the earth, then scraper moves forward filling the bowl 2. The front of the bowl 2 can be lifted to a transport position and apron 8 closed as illustrated in FIG. 6. The load of earth can be transported to the unloading location. The attached vehicle can lift the rear end of scraper 1, tilting the scraper forward to a near vertical position (FIG. 9) to dump the load. The scraper and attached vehicle can back away from the unloaded earth in front of the dumping scraper 1 and lower the scraper back to its transport position.

Alternatively, the bowl 2 can be unloaded by opening the front of the bowl 2 with respect to apron 8 and driving while unloading the material between the apron 8 and the front of the bowl 2. The method to empty the bowl 2 can include, but is not limited to, tilting the bowl or using an ejector. The apron 8 can then be closed and the bowl 2 positioned back to its transport position. This process can be done repeatedly in order to remove earth from the selected area.

In one embodiment, the dumping scraper 1 is used primarily as a dumpster to load material in from the top. The motorized vehicle portion need not be permanently attached to the vehicle, thus allowing the vehicle to be used elsewhere for a period of time until the dumping scraper is ready to be emptied. In another embodiment, the dumping scraper 1 can be loaded from the top by a moving and/or stationary conveying device.

The scraper as described herein can also include a powering vehicle. In such a case the vehicle attachment portion 4 is unnecessary as the scraper includes a powering or motorized vehicle portion and a scraper portion.

The motorized vehicle portion of a self-propelled scraper can be constructed as a part of the scraper not designed to detach from the scraper portion and/or the bowl. In other embodiments the motorized vehicle portion is detachable from the scraper portion. In fact, the motorized vehicle can be a skid steer type vehicle, a fork lift type vehicle, or any such vehicle capable of propelling the scraper and the attached scraper portion. It should also be noted that the tilting mechanism can also be disposed on the motorized vehicle portion rather than the scraper portion or on any pushing/propelling vehicle acting on the scraper rather than on the scraper itself.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A scraper machine having a proximal end and a distal end, an apron, a bowl, a cutting edge, and a vehicle attachment at the proximal end of the scraper machine, the scraper machine having a pivoting mechanism using at least one hydraulic cylinder that moves the bowl between a fully angled position and a flat position, in the flat position the cutting edge is in the position to cut into dirt and store the dirt in the bowl, while in the angled position the bowl is rotated such that dirt within the bowl can drop onto the ground in front of the scraper machine; and one or more weight bearing wheels, all of the one or more weight bearing wheels being proximal to the distal end of the bowl in the fully angled position.

2. The scraper machine of claim 1 wherein the cutting edge is connected to the bowl.

3. The scraper machine of claim 1 wherein the cutting edge is a part of the bowl.

4. The scraper machine of claim 1 wherein the cutting edge has multiple cutting blades.

5. The scraper machine of claim 4 wherein at least one blade extends further in a forward direction than at least one other blade.

6. The scraper machine of claim 4 wherein the cutting edge is curved.

7. The scraper machine of claim 1 wherein the cutting edge is curved and of single construction.

8. The scraper machine of claim 1 wherein the cutting edge is straight.

9. The scraper machine of claim 1 wherein a middle portion of the cutting edge extends further in a forward direction than at least one side portion of the cutting edge.

10. The scraper machine of claim 1 wherein the weight on each of the one or more wheels is distributed substantially evenly.

11. The scraper of claim 1 wherein the at least one wheel is removably attached to the scraper machine.

12. The scraper machine of claim 1 wherein at least part of the apron moves independently of the at least one wheel.

13. The scraper machine of claim 1 wherein the apron does not move with respect to the at least one wheel.

14. A self-propelled scraper machine including a motorized vehicle portion and a scraping portion, the scraping portion having an apron, a bowl, a cutting edge, and a proximal end, the scraper machine having a pivoting mechanism using at least one hydraulic cylinder that moves the bowl between a fully angled position and a flat position, in the flat position the cutting hydraulic in position to cut into dirt and store the dirt in the bowl, while in the angled position the bowl is rotated such that dirt within the bowl can drop onto the ground in front of the scraper machine; and one or more weight bearing wheels, all of the one or more weight bearing wheels being proximal to the distal end of the bowl in the fully angled position, the motorized vehicle portion attached to the scraping portion at the proximal end of the scraping portion and capable of positioning the apron, the bowl, and the cutting edge above the ground.

15. The self-propelled scraper machine of claim 14 having a dumping position that is within 5 feet of the front most portion of the motorized vehicle portion.

16. The self-propelled scraper machine of claim 14 wherein the motorized vehicle portion is a standard push vehicle designed to attach and detach to the scraping portion.

17. The self-propelled scraper machine of claim 14 wherein the cutting edge is a blade, the blade being flexible along the length dimension of the cutting edge.

18. The self-propelled scraper machine of claim 17 wherein the blade is curved.

* * * * *